United States Patent [19]

Wagaman

[11] Patent Number: 4,907,982

[45] Date of Patent: Mar. 13, 1990

[54] ELECTRICAL CONNECTOR FOR HIGH PRESSURE ENVIRONMENTS

[75] Inventor: James P. Wagaman, Chatsworth, Calif.

[73] Assignee: Kintec, Inc., Chasworth, Calif.

[21] Appl. No.: 278,140

[22] Filed: Nov. 30, 1988

[51] Int. Cl.[4] ..... H01R 23/70

[52] U.S. Cl. ..... 439/271; 439/488

[58] Field of Search ..... 439/271–282, 439/488–491

[56] References Cited

U.S. PATENT DOCUMENTS

| | | | |
|---|---|---|---|
| 4,588,247 | 5/1986 | Grappe et al. | 439/271 |
| 4,767,349 | 8/1988 | Pottier et al. | 439/271 |
| 4,808,115 | 2/1989 | Morton et al. | 439/271 |

*Primary Examiner*—Joseph H. McGlynn

*Attorney, Agent, or Firm*—Nilsson, Robbins

[57] ABSTRACT

A connector for high-pressure undersea environments includes first and second connector halves each attached to the ends of a cable for being coupled together in an undersea environment. Each connector includes a front shell, a housing and a rear shell. The front and rear shells are kept rotationally and axially fixed relative to the housing utilizing interconnect mechanism held in place by a housing end nut and a retaining nut, respectively. The cable is mated to a feed-through insert in the first shell and is held in place by a suitable tube spacer between the feed-through insert and a retaining ring extending from the interior of the front shell. The wires from the cable extend through an interior cavity of the housing where they are coupled to a contact insert sealingly positioned in the interior of the rear shell. A spacer tube retaining nut axially presses against a rear tube spacer moveable to press the front of the contact insert into abutment against an annular shoulder in the interior of the second shell.

11 Claims, 2 Drawing Sheets

FIG. 1D
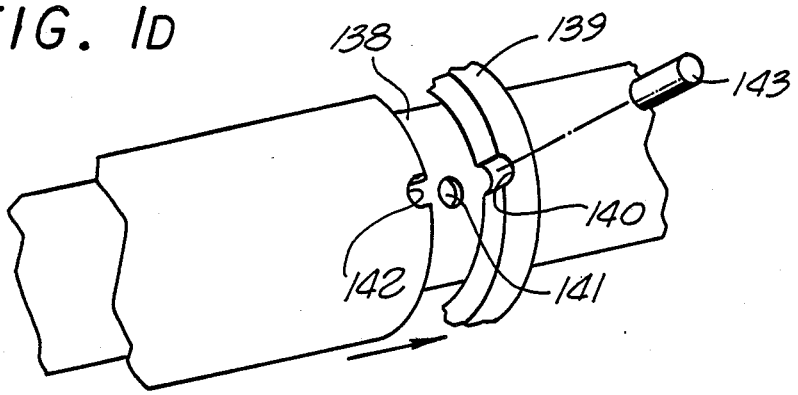
FIG. 2A
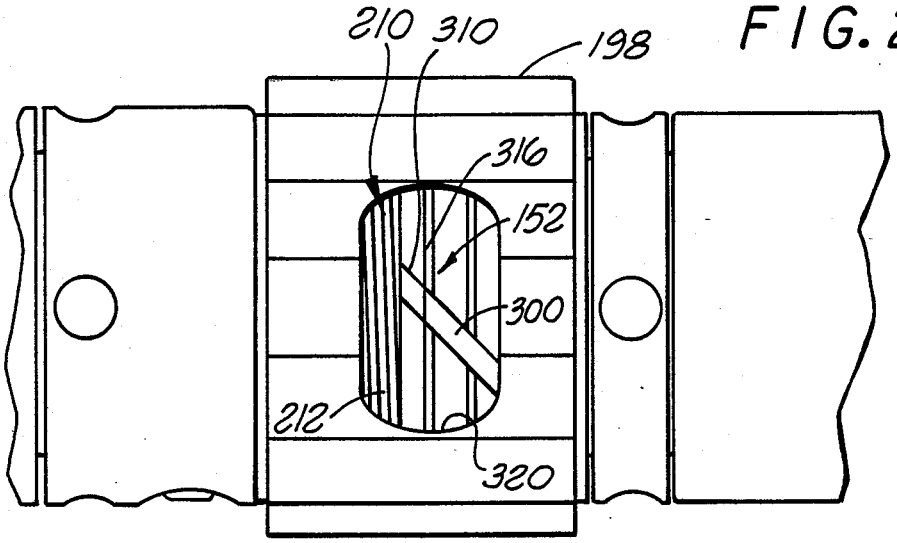
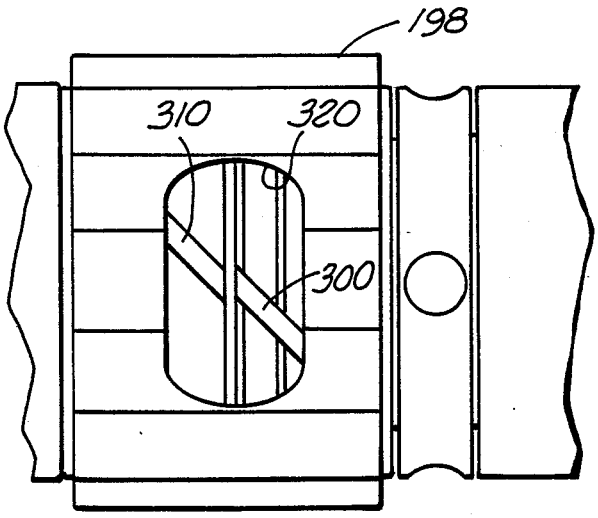
FIG. 2B

ELECTRICAL CONNECTOR FOR HIGH PRESSURE ENVIRONMENTS

BACKGROUND OF THE INVENTION

The present invention relates to electrical connectors and in particular to electrical connectors used in high pressure undersea environments which are adapted for being mated underwater by a diver.

Underwater electrical connectors for interconnecting cables are an essential component in many underwater systems such as offshore oil drilling platform systems and the like. The reliability of such connectors has long been critical since a failed connector can cause serious adverse effects on the operation of the offshore platform, consequences compounded because of the difficulty in raising the cable to make repairs. Two common causes of connector failure have been found to include corrosion due to cathodic effects and the salt water environment and designs which allow tolerances of multiple dimensions to become additive causing the connector to exceed specification or designs which present the diver with the possibility of being confused into actually disassembling rather than decoupling the connector. Consequently, connector assemblies useful in underwater environments must have a design and be made of materials which will be highly resistant to corrosion and must be of a configuration which enables a diver to reliably couple and decouple the connector without the risk of disassembling the connector itself.

Heretofore, connectors used in undersea environments have addressed these problems and have experienced good reliability. Even so, even greater immunity from corrosion is required. Furthermore, a design which can be easily decoupled by a diver in the undersea environment without risking accidental disassembly of the connector is also desired.

Accordingly, the present invention provides a connector having an engaging nut which is easily recognizable and distinguishable from other parts of the connector assembly so that a diver will not mistakenly disassemble the connector. Further, the present invention provides interconnect means for interconnecting the housing to a front shell and a rear shell thereby eliminating the conventionally used external spring retaining ring which is vulnerable to corrosion. In addition, the present invention is configured to have a rear housing retaining nut adjacent the engaging nut wherein the thread is placed rearwardly rather than forwardly of the interconnect means, thus enabling the length of the connector to be substantially decreased and made more compact. This configuration also facilitates distinguishing the retaining nut from the engaging nut to prevent the above described accidental disassembly of the connector when decoupling is intended.

An additional advantage of the present invention is an internal arrangement which eliminates the possibility that the tolerances of several components and dimensions will add to exceed the maximum tolerance of the connector itself. In certain instances, prior devices have had numerous dimensions, each with close tolerances, which have become additive when the connector is assembled on the end of the cable. This additive effect has caused the overall tolerance of the two mating sides of the connector to exceed specifications which in turn prevented the connector from being coupled so as to create the necessary mating seal. The present invention minimizes the number of dimensions whose tolerances are additive thereby virtually eliminating the possibility that the connector will exceed specification due to additive tolerances.

Finally, a indicator mechanism is provided to enable a diver to visually confirm that the two connector parts are completely and properly mated.

SUMMARY OF THE INVENTION

The present invention comprises a connector for high pressure environments. The connector includes a first assembly coupled to the end of a first cable which has at least one first wire and a second assembly coupled to a second cable which also has at lease one second wire. The second assembly is configured to mate with the first assembly to thereby connect the first cable to the second cable. The first and second assemblies each have a front shell with an axially disposed front shell interior surface in which a circumferentially disposed front shell interior surface groove is disposed, and an axially disposed front shell exterior surface with a circumferentially disposed front shell exterior surface groove therein. A feed-through insert is positioned in the front shell. The feed-through insert has a cable facing end for receiving the cable, a wire facing end opposite the cable facing end through which the individual wires of the cable protrude, and a radially disposed feed-through insert abutment flange. A retaining means extends radially from the front shell interior surface groove to define a radially extending retainer abutment shoulder. A front tube spacer is positioned with its rear end in abutting relationship against the retainer abutment shoulder and its front end in abutting relationship against the feed-through insert abutment flange so that the feed-through insert is axially aligned and retained in the front shell. Each assembly also includes a housing which has a housing interior surface, a rear region, a circumferential housing interior thread at the rear region and a front region. The front region is positioned in sealed relationship over the front shell exterior surface with the front region also having a circumferentially disposed housing exterior thread. A first interconnect means is positioned between the housing interior surface and the front shell exterior surface for interconnecting the housing and the front shell in axially and rotationally immoveable relationship. A housing end nut is positioned over the interconnect means. The housing end nut has an interior radially disposed nut abutment shoulder for abutment against the interconnect means and a circumferential nut interior thread for threading onto the housing exterior thread for retaining the housing on the front shell exterior surface. A rear shell is then provided with a rear shell outside surface, a front facing, radially extending rear shell abutment shoulder and a rear shell front end with a shell interior thread therein. A contact insert for positioning in the rear shell includes a contact front end for receiving the ends of the wires, a contact rear end with at least one mating contact, a rear facing radially disposed contact insert abutment flange for abutting against the rear shell abutment shoulder, and a front facing radially disposed contact insert abutment shoulder. A rear tube spacer is positioned in the rear shell has a first end in abutting relationship against the contact insert abutment shoulder. A spacer tube retaining nut is threaded into the shell interior thread so that one of its ends abuts against the second end of the rear tube spacer for causing the contact insert abutment flange to be pressed into contact against the rear shell abutment shoulder for axially positioning and retaining the contact insert in the rear shell. A second interconnect means is then positioned between the rear shell outside surface and the housing interior surface for interconnecting the housing and the rear shell in axially and rotationally immoveable relationship. A housing retaining nut with a nut exterior thread is then screwed into the housing interior thread to retain the housing on the rear shell.

The first assembly further includes an engaging nut on the first assembly rear shell axially adjacent the housing retaining nut in rotationally moveable but axially retained relationship on the rear shell.

The rear shell of the second assembly further has an outside threaded engaging end, the engaging nut engaging with the outside threaded engaging end for coupling the first and second assemblies together whereby the mating contacts of the first and second assemblies are coupled together for electrically coupling the first and second cables.

The connector further includes a positive mate indicating apparatus which comprises an indicator strip disposed across the junction between the first and second assemblies. When the first and second assemblies are fully mated, the indicator strip appears as a single continuous strip. When the first and second assemblies are not fully mated, the indicator strip will be discontinuous giving the diver who is mating the connector halves and indication that further rotation of the coupling nut is required.

BRIEF DESCRIPTION OF THE DRAWINGS

A complete understanding of the present invention and of the above and other advantages may be gained from a consideration of the following description of the preferred embodiments taken in conjunction with the accompanying drawings in which:

FIG. 1D is a pictorial detail illustrating one embodiment of an interconnect means for preventing axial and rotational movement between the housing and the shell of the connector in accordance with the invention;

FIG. 2A is a side view illustrating a positive mate indicator incorporated in the coupling nut;

FIG. 2B is an illustration of the positive mate indicator mechanism of FIG. 2A showing the first half and second half of the connector in the non-fully mated position.

DETAILED DESCRIPTION

Figure 1A:
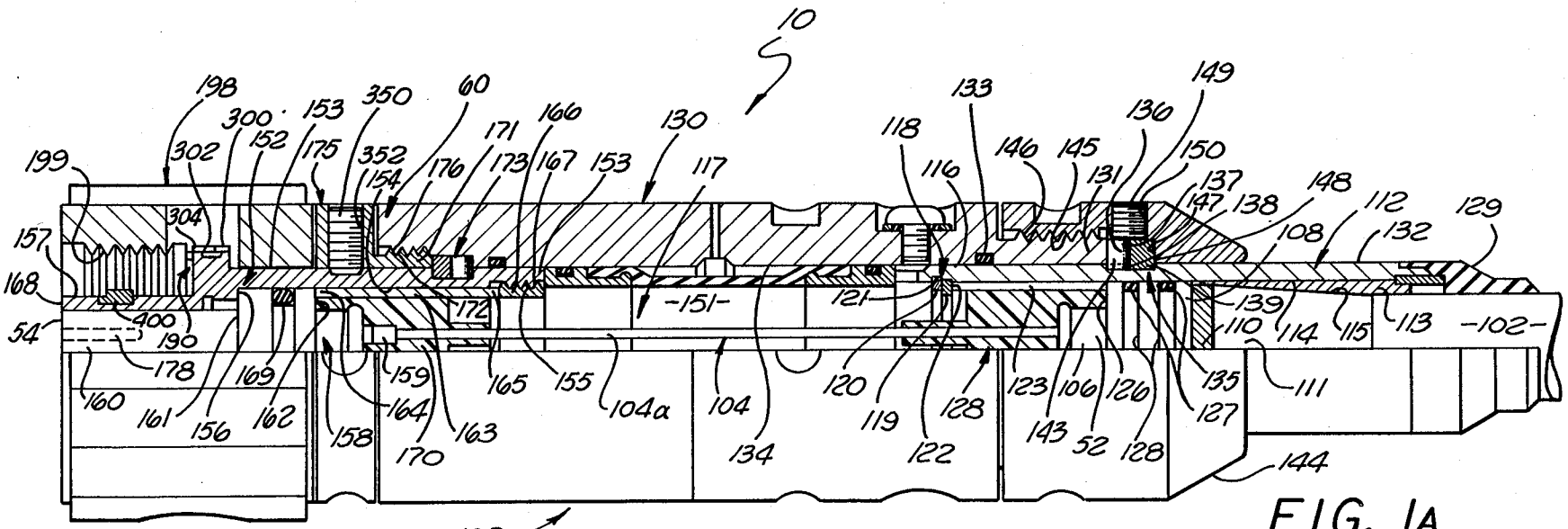
FIG 1A is a side, partial cut away view of a connector half attaehed to one cable in accordance with the invention.
Figure 1B:
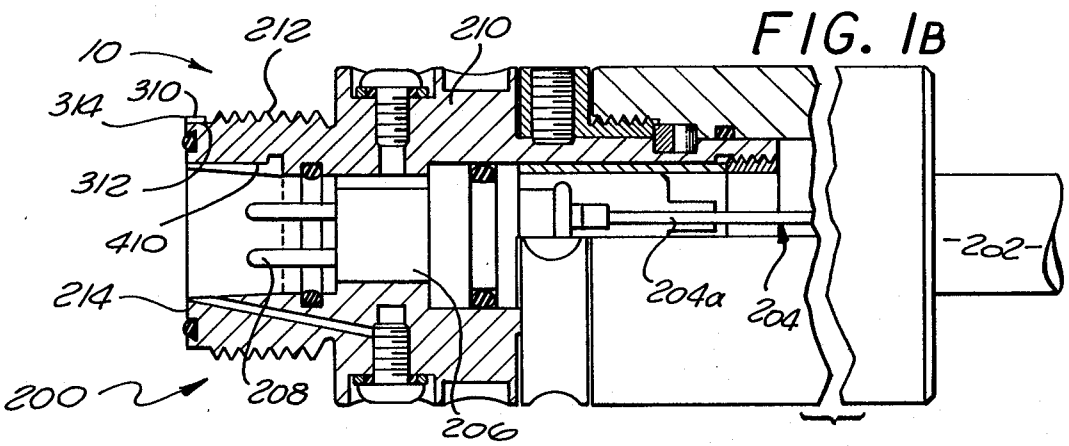
FIG. 1B is a truncated cut away view of the other half of the connector attached to a second cable in accordance with the invention.
Figure 1C:
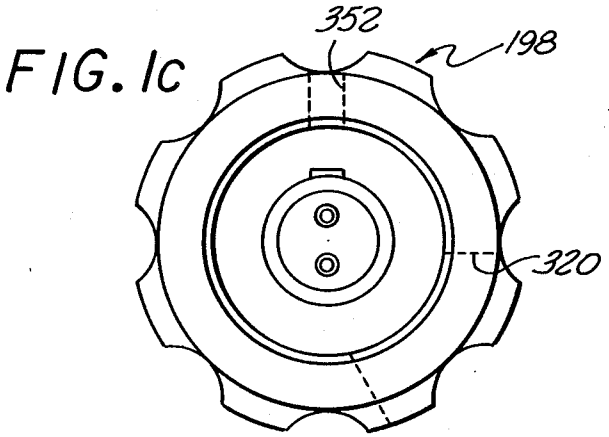
FIG. 1C is an end view of an engaging nut for interconnecting the two halves of the connector illustrated in FIGS. 1A and 1B.

Referring to FIGS. 1A, 1B and 1C, a connector 10 includes a first assembly (connector half) 100 and a second assembly (connector half) 200 configured for being joined together by an engaging nut 198. In the illustrated embodiment, the first assembly 100 is the female part of the connector and the second assembly 200 is the male part of the connector. Except for their respective mating ends, the first assembly 100 and second assembly 200 have substantially identical configurations. Accordingly, only the configuration of the first assembly 100 will be described in detail. The first assembly 100 is coupled to the end of a first cable 102 while the second assembly 200 is coupled to the end of a second cable 202. The first cable 102 encases and surrounds a first set of wires 104 which includes at least one wire **104*a*, while the second cable 202 encases and surrounds a second set of wires 204 which includes at least on second wire 204*a*. In the usual arrangement, both the first cable 102 and the second cable 202 will each have a plurality of first and second wires interconnected to one another in a predefined arrangement when the first assembly 100 and the second assembly 200 are joined and locked together by the coupling nut 198**.

Turning more specifically to FIG. 1A, the end of the first cable is stripped to expose extended lengths of the first wires 104. The exposed lengths of the wires 104 are inserted through a feed-through insert 106 which has a wire facing end 52 and a cable facing end 108. The cable facing end 108 is attached to the outside casing 50 of the first cable 102 using a suitable potting gasket 110 and securing polyester resin 111. The feed-through insert 106 is positioned inside a front shell 112 having a front shell interior surface 114, a front end 115 and a rear end 116. The feed-through insert 106 is secured against movement relative to the front shell 112 using a suitable wedge potting 113 wedged between the front shell interior surface 114 and the outside surface (casing) 50 of the first cable 102. The front shell front end 115 is juxtaposed radially adjacent the first cable 102 and the front shell rear end 116 is juxtaposed radially adjacent an interior cavity 117 defined by the first assembly 100.

A retaining means 118 is disposed circumferentially around and extending from the front shell interior surface 114 near the front shell rear end 116 to provide a inwardly projecting radially disposed retainer abutment shoulder 122. In one embodiment, the retaining means 118 includes a retaining washer 119 and a retaining ring 120 positioned rearwardly of the retaining washer 119 in a front shell interior surface groove 121. The retaining washer 119 projects radially into the interior cavity 117 from the front shell interior surface 114 to define the retainer abutment shoulder 122.

A front spacer, such as the front tube spacer 123, is positioned inside the front shell 112 adjacent the front shell interior surface 114. The front tube spacer 123 has a spacer rear end 124 and a spacer front end 125 with the spacer rear end 124 positioned in abutting relationship against the retainer abutment shoulder 122. The feed-through insert 106 has a radially disposed, outwardly extending, feed-through insert abutment flange 126 which abuts against the spacer front end 125 so that the front tube spacer 123 will prevent rearward axial movement of the feed-through insert 106 relative to the front shell 112.

In order to provide sealing between the interior 117 of the first assembly 100 and the outside environment, a pair of O-ring seals 127 are positioned in circumferential grooves 128 about the periphery of the feed-through insert 106 so as to press against the front shell interior surface 114. A feed-through insert boot 128 made of a suitable elastomeric material is also stretch fitted both over the wire facing end 52 of the feed-through insert 106 and over each of the wires 104 to form a seal between the surface of the wires and the boot and between the surface of the feed-through insert and the boot. Further, a front external boot 129 is positioned over the outside front end of the front shell 112 and a region of the outside surface 50 of the first cable 102 adjacent to the front end of the front shell 112.

The housing 130 has a rear region 60 and a front region 131 which is slidingly positioned over the front shell exterior surface 132 at the rear end of the front shell 116. The housing 130 has a housing interior surface 134 which is generally in contact with the front shell exterior surface 132. An O-ring seal 133 is then positioned in a circumferential groove to form a seal between the housing interior surface 134 and the front shell exterior surface 132.

Axial positioning and alignment of the housing 130 relative to the front shell 112 is accomplished by a first interconnect means 135. The first interconnect means 135 provides an outwardly extending radial first interconnect shoulder 136. The housing 130 is configured to define a front end abutment surface 137. The front end abutment surface 137 is positioned to abut against the first interconnect shoulder 136 to limit forward movement of the housing 130 relative to the front shell 112.

Prevention of rotational movement between the housing 130 and the front shell 112 is also desired. Therefore, the first interconnect means 135 is also configured to prevent such relative rotational movement. Such an arrangement may be provided by a pin-split ring arrangement wherein the front shell exterior surface 132 of the front shell 112 is provided with a front shell exterior surface groove 138. A split ring 139 is then positioned in the groove 138 to provide the first interconnect shoulder 136 against which the front end abutment surface 138 abuts. To prevent rotational movement, the split ring has a radially disposed cylindrical half orifice 140 (FIG. 1D) and the front end abutment surface 137 has a mating radially disposed half orifice 142 configured to be aligned with an orifice 141 disposed in the bottom of the groove 138 of the front shell. To join the housing 130 in axial and rotationally immoveable relationship to the front shell 112, the split ring 139 is positioned in the front exterior surface groove 138 and the front end abutment surface 137 is abutted against the first interconnect shoulder 136 provided by the rear facing radial side of the split ring. The orifices 140 and 142 are then aligned with each other and radially juxtaposed over the orifice 141. A suitable dowel pin 143 is then inserted through the orifice defined by the half orifices 140 and 142 into engagement in the orifice 141. So long as the front end abutment surface 137 of the housing 130 remains in abutting relationship against the first interconnect shoulder 136 with the pin 143 positioned in the groove 141, rotational and axial movement between the housing 130 and the front shell 112 will be prevented.

To ensure retention of the housing 130 in abutting relationship against the split ring 139, a housing end nut 144 having a nut interior thread 145 is slidingly positioned over the front shell exterior surface 132. The housing 130 further has a housing exterior thread 146 extending rearwardly from the front end abutment surface 137 for being engaged by the nut interior thread 145. The housing end nut 144 further has a radially extending nut abutment shoulder 147 spaced forward of the nut interior thread 145 for engagement against the radially projecting front edge 148 of the interconnect means 135. Accordingly, when the housing end nut 144 is fully engaged on the housing 130 with the housing exterior thread 146 and the nut interior thread 145 fully mated, the nut abutment shoulder 147 will press against the front edge 148 of the interconnect means 135 with the front end abutment surface 137 of the housing 130 pulled into pressing relationship against the first interconnect shoulder 136 to thereby retain the split ring 139 and dowel pin 143 in proper position to prevent both radial and axial relative movement between the housing 130 and the front shell 112. Finally, a suitable set screw 149 is screwed into a threaded orifice 150 through the housing end nut 144 to prevent the housing end nut from loosening once the fully engaged arrangement described above has been achieved.

The first assembly 100 further includes a rear shell 152 having a rear shell front end 153, a rear shell rear end 157 opposite the front end 153, a rear shell outside surface 153 and a rear shell interior surface 154. A shell interior thread 155 is provided in the rear shell interior surface 154 at the front end 153. A radially disposed front facing rear shell abutment shoulder 156 is provided along the rear shell interior surface 154 at a central location between the rear shell front end 153 and the rear shell rear end 157.

In accordance with the invention, the wires 104 extend through the interior cavity 117, which is preferably filled with a dielectric fluid 151, to a contact insert 158 disposed interiorly of the rear shell 152 where the wires 104 are appropriately coupled to the individual cavity facing contacts of the contact insert 158. The contact insert 158 has a contact front end 159 at which the wires 104 are attached, and a contact rear end 160 opposite the contact front end 159. The contact insert 158 further has a radially extending rear facing contact insert abutment flange 161 and a front facing contact insert abutment shoulder 162. The contact insert 158 is slidingly inserted into the rear shell 152 until the contact insert abutment flange 161 contacts and abuts against rear shell abutment shoulder 156 to prevent further rearward axial movement of the contact insert 158 relative to the rear shell 152. A rear spacer such as rear tube spacer 163 having a first end 164 and a second end 165, is inserted into the rear shell 152 so as to be adjacent the rear shell interior surface 154. The rear tube spacer 163 is inserted until first end 164 presses against the contact insert abutment shoulder 161. A spacer tube retaining nut 166 with an exterior thread 167 is then screwed into the rear shell front end 153 in engagement with the shell interior thread 155 to press the second end 165 of the rear tube spacer 163 against the contact insert abutment shoulder 162. Thus, when the spacer tube retaining nut 166 is fully tightened, the rear facing edge of the spacer tube retaining nut 166 will press against the second end 165 of the rear tube spacer 163 to cause the first end 164 of the rear tube spacer 163 to press against the contact insert abutment shoulder 162 which in turn forces the rear contact insert abutment flange 161 to press against the rear shell abutment shoulder 156.

Advantageously, this arrangement eliminates the possibility that tolerances of various dimensions will be additive to such an extent that the connector will be out of specification making complete coupling impossible. Thus, in the present invention, the only dimensions whose tolerances need be of concern are the dimension between the rear shell abutment shoulder 156 and the front edge 168 of the rear shell 152 and the dimension between the rear shell abutment shoulder and the front end 54 of the contact insert 158. In prior art devices instead of two dimensions, there were as many as eight dimensions whose tolerances could become additive.

To provide sealing, a suitable O-ring 169 is positioned in a groove in the contact insert to press against the rear shell interior surface 154. A contact boot 170 is provided over the wires 104 and the contact front end 159 in a manner similar to that previously described in conjunction with the feed-through boot 128.

The housing 130 further has a rear region 60 which has a housing interior thread 172. In order to prevent axial and rotational movement between the housing 130 and the rear shell 152, a second interconnect means 173 substantially the same as the first interconnect means 135 is provided in a suitable groove 174 in the rear shell outside surface 153. A housing retaining nut 175 having a retaining nut front end 171 with a nut exterior thread 176 thereat is then screwed into engagement with the housing interior thread 172 to come into contact with the second interconnect means 173 to thereby hold the rear shell and housing in axially and rotationally immovable relationship relative to one another in the same manner as previously described in connection with the operation of the first interconnect means 135 as illustrated in FIG. 1D.

The contact insert 158 has one or more mating contacts 178 which in the embodiment illustrated are inserts for electrically coupling with the mating second assembly 200. Finally, the engagement nut 198 as illustrated in FIG. 1C is rotationally mounted to the rear end 157 of the rear shell 152 in a conventional manner. To provide attachment, the engaging nut has an engaging nut interior thread 199.

Turning to FIG. 1B, a contact insert 206 is provided to receive the various second contact wires 204. Extending from the end of the contact insert 206 are one or more mating contacts 208 comprising electrically conductive pins arranged to mate with the inserts 178 of FIG. 1A. The contact insert 206 is inserted and retained within a rear shell 210 in a manner similar to that previously described in connection with FIG. 1A. However, instead of an engaging nut 198, the rear shell 210 has an external thread 212 configured to engage with the interior thread of the engaging nut 198.

Referring to FIGS. 2A and 2B, a positive mate indicator mechanism is incorporated to positively show when the first assembly 100 and the second assembly 200 are fully and properly mated. The need for this positive mate indicator results from the fact that the connector illustrated in FIGS. 1A and 1B is primarily used in underwater environments where divers manually couple the first assembly and the second assembly by positioning the ends adjacent one another and then rotating the engagement nut 198. A proper seal and alignment between the first assembly and the second assembly is essential to prevent sea water or other contamination from invading the joint area and causing undesirable corrosion or electrical shorting by conduction through the contaminating fluid. Accordingly, it is desired to have the front radially disposed face 214 of the rear shell 210 in abutting relationship against the rear facing mating surface 190 of the rear shell 152.

To provide the diver with a positive indication of a proper mate, a first half indicator strip 300 is provided to extend forwardly from a first annular shell edge 304 defined as the edge between the radially disposed mating surface 190 and the circumferential rear shell outside surface 153 along a surface region 302 of the rear shell outside surface 153 and a similar second half indicator strip 310 is provided to extend from a second annular shell edge 314 defined as the edge between the radially disposed shell face 214 and the circumferential second shell outside surface 311 along a region 312 of the outside surface 311 toward the threads 212. Referring to FIG. 2A in conjunction with FIGS. IA and IB, the indicator strips 310 and 300 preferably extend diagonally across a mating junction 316 between the shell 152 and the shell 210. The indicator strips 300 and 310 are positioned at locations on the periphery of the rear shells 210 and 152 respectively to be in alignment with each other such as by aligning each half 300 and 310 with a annular alignment key 400 (FIG. 1A) in the shell 152 and a corresponding annular alignment key hole 410 (FIG. 1B) in shell 210. In any event, the indicator strips 300 and 310 are aligned so that when the front face 214 is properly juxtaposed in annular and axial alignment and in pressing relationship against the rear facing mating surface 190, the two indicator strips 300 and 310 will appear as a single indicator strip extending across the mating junction 316. However, if a proper mating has not been achieved so that the front face 214 is still spaced from the rear facing mating surface 190, the indicator strips 300 and 310 will not align but rather will be discontinuous as illustrated in FIG. 2B.

In order for the diver or other user to be able to observe whether or not the strips 300 and 310 are aligned to indicate a positive mating, the engaging nut 198 has disposed therethrough at least one but preferably a plurality of observation ports 320 so that the strips 300 and 310 can be readily observed. It will also be appreciated that several strip pairs of the same or different colors can be arranged about the periphery of the respective shells 152 and 210 so that alignment with one of the ports can be assured.

Once a positive mate indication has been achieved, an anti-rotation screw 350 may be inserted into a threaded orifice 352 to press against the rear shell 152 and thereby lock the engaging nut 198 against further rotation and hence lock the first assembly into interconnection with the second assembly 200.

While specific embodiments of the present invention have been described, it will be appreciated that numerous alternations and variations are possible without departing from the invention in its broadest aspects.

What is claimed is:

1. A connector for high pressure environments comprising a first assembly coupled to the end of a first cable having at least one first wire and a second assembly coupled to a second cable having at lease one second wire, the second assembly configured to mate with the first assembly to thereby connect the first cable to the second cable, the first and second assemblies each comprising:

a front shell having an axially disposed front shell interior surface with a circumferentially disposed front shell interior surface groove therein and an axially disposed front shell exterior surface with a circumferentially disposed front shell exterior surface groove therein;

a feed-through insert positioned in the front shell, the feed-through insert having a cable facing end for receiving the cable, a wire facing end opposite the cable facing end through which the individual wires of the cable protrude, and a radially disposed feed-through insert abutment flange;

retaining means positioned for extending radially from the front shell interior surface groove for defining a radially extending retainer abutment shoulder;

a front tube spacer having a spacer rear end in abutting relationship against the retainer abutment shoulder and a spacer front end opposite the spacer rear end in abutting relationship against the feed-through insert abutment flange whereby the feed-through insert is axially aligned and retained in the front shell;

a housing having a housing interior surface, a rear region, a circumferential housing interior thread at the rear region and a front region, the front region positioned in sealed relationship over the front shell exterior surface, the front region of the housing having a circumferentially disposed housing exterior thread;

first interconnect means positioned between the housing interior surface and the front shell exterior surface for interconnecting the housing and the front shell in axially and rotationally immoveable relationship;

a housing end nut positioned over the interconnect means and having a interior radially disposed nut abutment shoulder for abutment against the interconnect means and a circumferential nut interior thread for threading onto the housing exterior thread for retaining the housing on the front shell exterior surface;

a rear shell having a rear shell outside surface, a front facing, radially extending rear shell abutment shoulder and a rear shell front end with a shell interior thread therein;

a contact insert having a contact front end for receiving the ends of the wires and a contact rear end with at least one mating contact, and further having a rear facing radially disposed contact insert abutment flange for abutting against the rear shell abutment shoulder and having a front facing radially disposed contact insert abutment shoulder;

a rear tube spacer having a first end in abutting relationship against the contact insert abutment shoulder and a second end opposite the first end;

a spacer tube retaining nut having an exterior thread for being threaded into the shell interior thread, the spacer tube retaining nut having one end abutting against the second end of the rear tube spacer for causing the contact insert abutment flange to be pressed into contact against the rear shell abutment shoulder for axially positioning and retaining the contact insert in the rear shell;

second interconnect means between the rear shell outside surface and the housing interior surface for interconnecting the housing and the rear shell in axially and rotationally immoveable relationship; and a housing retaining nut having a retaining nut front end with a nut exterior thread for threadingly mating with the housing interior thread for retaining the extension housing on the rear shell;

the first assembly further having an engaging nut on the first assembly rear shell axially adjacent the housing retaining nut in rotationally moveable but axially retained relationship on the rear shell, the engaging nut having an engaging nut interior thread;

the rear shell of the second assembly further having an outside threaded engaging end, the engaging nut threadingly engageable with the outside threaded engaging end for coupling the first and second assemblies together whereby the mating contacts of the first and second assemblies are coupled together for electrically coupling the first and second cables.

2. A connector comprising a first assembly coupled to the end of a first cable having at least one first wire and a second assembly coupled to a second cable having at lease one second wire, the second assembly configured to mate with the first assembly to thereby connect the first cable to the second cable, the first and second assemblies each comprising:

a front shell having an axially disposed front shell interior surface and an axially disposed front shell exterior surface;

a feed-through insert positioned in the front shell, the feed-through insert having a cable facing end for receiving the cable, a wire facing end opposite the cable facing end through which the individual wires of the cable protrude, and a radially disposed feed-through insert abutment flange;

retaining means positioned for extending radially from the front shell interior surface for defining a radially extending retainer abutment shoulder;

a front spacer having a spacer rear end in abutting relationship to retainer abutment shoulder and a spacer front end opposite the spacer rear end in abutting relationship against the feed-through insert abutment flange whereby the feed-through insert is axially aligned and retained in the front shell;

a housing having a housing interior surface, a rear region, a circumferential housing interior thread at the rear region and a front region, the front region positioned in sealing relationship over the front shell exterior surface, the front region of the housing having a circumferentially disposed housing exterior thread;

first interconnect means positioned between the housing interior surface and the front shell exterior surface for interconnecting the housing and the front shell in axially and rotationally immoveable relationship;

a housing end nut positioned over the interconnect means and having a interior radially disposed nut abutment shoulder for abutment against the interconnect means and a circumferential nut interior thread for threading onto the housing exterior thread for retaining the housing on the front shell exterior surface;

a rear shell having a rear shell outside surface, a front facing, radially extending, rear shell abutment shoulder and a rear shell front end with a shell interior thread therein;

a contact insert having a contact front end for receiving the ends of the wires and a contact rear end with at least one mating contact, and further having a rear facing radially disposed contact insert abutment flange for abutting against the rear shell abutment shoulder and having a front facing radially disposed contact insert abutment shoulder;

a rear spacer having a first end in abutting relationship against the contact insert abutment shoulder and a second end opposite the first end;

a spacer retaining nut having an exterior thread for being threaded into the shell interior thread, the spacer retaining nut having one end abutting against the second end of the rear spacer for causing the contact insert abutment flange to be pressed into contact against the rear shell abutment shoulder for axially positioning and retaining the contact insert in the rear shell;

second interconnect means between the rear shell outside surface and the housing interior surface for interconnecting the housing and the rear shell in axially and rotationally immoveable relationship; and a housing retaining nut having a retaining nut front end with a nut exterior thread for threadingly mating with the housing interior thread for retaining the extension housing on the rear shell;

the first assembly further having an engaging nut on the first assembly rear shell axially adjacent the housing retaining nut in rotationally moveable but axially retained relationship on the rear shell, the engaging nut having an engaging nut interior thread;

the rear shell of the second assembly further having an outside threaded engaging end, the engaging nut threadingly engageable with the outside threaded engaging end for coupling the first and second assemblies together whereby the mating contacts of the first and second assemblies are coupled together for electrically coupling the first and second cables.

3. The connector of claim 1 wherein the first assembly has a radially disposed first mating surface and the second assembly has a radially disposed second mating surface, the first and second mating surfaces positioned in abutting relationship to each other to define a mating junction edge therebetween when the first and second assemblies are in fully mated relationship to one another, the first and second assemblies having annular alignment means for annularly aligning the first and second assemblies in a predefined fixed annular mating alignment, the connector further comprising a positive mate indicating apparatus comprising:

a first indicator band disposed on the rear shell outside surface of the first assembly to extend forwardly from the first mating surface, the first indicator band being positioned in a predefined annular location relative to annular alignment means;

a second indicator band disposed on the second shell outside surface of the second assembly to extend forwardly from the second mating surface, the second indicator band being positioned in the predefined annular location relative to the annular alignment means whereby the first and second indicator bands will align with each other across the mating junction edge in a continuous single indicator band when the first assemble is in fully mated relationship with the second assembly but showing a visible discontinuity at the mating junction edge when the first assembly is not in fully mated relationship with the second assembly; and the housing retaining nut on the first assembly having at least one radially disposed orifice therethrough, the orifice juxtaposed opposite a portion of the mating junction edge for enabling visual observation of the indicator bands to observe the relative alignment of the indicator bands for confirming that the first and second assemblies are in the fully mated relationship to each other.

4. The connector of claim 2 wherein the first assembly has a radially disposed first mating surface and the second assembly has a radially disposed second mating surface, the first and second mating surfaces positioned in abutting relationship to each other to define a mating junction edge therebetween when the first and second assemblies are in fully mated relationship to one another, the first and second assemblies having annular alignment means for annularly aligning the first and second assemblies in a predefined fixed annular mating alignment, the connector further comprising a positive mate indicating apparatus comprising:

a first indicator band disposed on the rear shell outside surface of the first assembly to extend forwardly from the first mating surface, the first indicator band being positioned in a predefined annular location relative to annular alignment means;

a second indicator band disposed on the second shell outside surface of the second assembly to extend forwardly from the second mating surface, the second indicator band being positioned in the predefined annular location relative to the annular alignment means whereby the first and second indicator bands will align with each other across the mating junction edge in a continuous single indicator band when the first assemble is in fully mated relationship with the second assembly but showing a visible discontinuity at the mating junction edge when the first assembly is not in fully mated relationship with the second assembly; and the housing retaining nut on the first assembly having at least one radially disposed orifice therethrough, the orifice juxtaposed opposite a portion of the mating junction edge for enabling visual observation of the indicator bands to observe the relative alignment of the indicator bands for confirming that the first and second assemblies are in the fully mated relationship to each other.

5. A connector comprising a first assembly coupled to the end of a first cable having at least one first wire and a second assembly coupled to a second cable having at lease one second wire, the second assembly configured to mate with the first assembly to thereby connect the first cable to the second cable, the first and second assemblies each comprising:

a front shell having an axially disposed front shell interior surface and an axially disposed front shell exterior surface;

a feed-through insert positioned in the front shell, the feed-through insert having a cable facing end for receiving the cable, a wire facing end opposite the cable facing end through which the individual wires of the cable protrude, and a radially disposed feed-through insert abutment flange;

retaining means extending radially from the front shell interior surface for defining a radially extending retainer abutment shoulder;

a front spacer having a spacer rear end in abutting relationship to retainer abutment shoulder and a spacer front end opposite the spacer rear end in abutting relationship against the feed-through insert abutment flange whereby the feed-through insert is axially aligned and retained in the front shell;

a housing having a front region positioned in sealed relationship over the front shell exterior surface;

first interconnect means positioned between the housing interior surface and the front shell exterior surface for interconnecting the housing and the front shell in axially and rotationally immoveable relationship;

a front housing retaining means positioned over the interconnect means for retaining the housing on the front shell exterior surface;

a rear shell having a front facing, radially extending rear shell abutment shoulder;

a contact insert having a contact front end for receiving the ends of the cable wires and a contact rear end with at least one mating contact, and further having a rear facing radially disposed contact insert abutment flange for abutting against the rear shell abutment shoulder and having a front facing radially disposed contact insert abutment shoulder;

a second spacer having a first end in abutting relationship against the contact insert abutment shoulder and a second end opposite the first end;

a spacer retaining means for being interconnect to the front end of the rear shell, the spacer retaining means having one end abutting against the second end of the second spacer for causing the contact insert abutment flange to be pressed into contact against the rear shell abutment shoulder for axially positioning and retaining the contact insert in the rear shell;

second interconnect means between the rear shell outside surface and the housing interior surface for interconnecting the housing and the rear shell in axially and rotationally immoveable relationship; and a rear housing retaining means for retaining the extension housing on the rear shell;

the first assembly further having a first engaging means on the rear shell axially adjacent the rear housing retaining means in rotationally moveable but axially retained relationship on the rear shell;

the rear shell of the second assembly further having a second engaging means, the first engaging means being mateable with the second engaging means for coupling the first and second assemblies together whereby the mating contacts of the first and second assemblies are coupled together for electrically coupling the first and second cables.

6. The connector of claim 5 wherein the first assembly has a radially disposed first mating surface and the second assembly has a radially disposed second mating surface, the first and second mating surfaces positioned in abutting relationship to each other to define a mating junction edge therebetween when the first and second assemblies are in fully mated relationship to one another, the first and second assemblies having annular alignment means for annularly aligning the first and second assemblies in a predefined fixed annular mating alignment, the connector further comprising a positive mate indicating apparatus comprising:

a first indicator band disposed on the rear shell outside surface of the first assembly to extend forwardly from the first mating surface, the first indicator band being positioned in a predefined annular location relative to annular alignment means;

a second indicator band disposed on the second shell outside surface of the second assembly to extend forwardly from the second mating surface, the second indicator band being positioned in the predefined annular location relative to the annular alignment means whereby the first and second indicator bands will align with each other across the mating junction edge in a continuous single indicator band when the first assemble is in fully mated relationship with the second assembly but showing a visible discontinuity at the mating junction edge when the first assembly is not in fully mated relationship with the second assembly; and the housing retaining nut on the first assembly having at least one radially disposed orifice therethrough, the orifice juxtaposed opposite a portion of the mating junction edge for enabling visual observation of the indicator bands to observe the relative alignment of the indicator bands for confirming that the first and second assemblies are in the fully mated relationship to each other.

7. A positive mate indicating apparatus for a connector, the connector comprising a first assembly and a second assembly for mating with the first assembly and means for mating the first and second assemblies together in a predefined fixed annular alignment, the first assembly having an annular, radially extending first mating surface and a first cylindrical surface extending axially from the first mating surface to define an annular first mating edge between the first mating surface and the first cylindrical surface, and wherein the second assembly has an annular radially extending second mating surface and a second cylindrical surface extending axially from the second mating surface to define an annular second mating edge between the second mating surface and the second cylindrical surface, the first and second mating surfaces being in abutting relationship to each other to define an annular mating junction when the first and second assemblies are in fully mated relationship to one another, the positive mate indicating apparatus comprising:

an indicator strip disposed on the first and second cylindrical surfaces across the mating junction, the indicator strip having a first half on one side of the mating junction and a second half on the other side of the mating junction the first and second halves of the indicator strip aligning to appear as a single continuous strip extending across the mating junction only when the first assembly is in fully mated relationship with the second assembly, the indicator strip having a visible discontinuity at the first and second mating edges when the first assembly is not in fully mated relationship with the second assembly; and a housing retaining nut on the first assembly, the housing retaining nut having at least one radially disposed orifice therethrough, the orifice juxtaposed opposite a section of the mating junction for enabling visual observation of the indicator strip for confirming that the first and second assemblies are in the fully mated relationship to each other.

8. The positive mate indicator apparatus of claim 7 wherein the indicator strip is disposed on the first and second cylindrical surfaces to have an angled orientation relative to the mating junction and the first and second mating edges.

9. The positive mate indicator apparatus of claim 7 wherein the indicator strip is in annular alignment with the means for mating in the predefined annular alignment.

10. A connector comprising a first assembly coupled to the end of a first cable having at least one first wire and a second assembly coupled to a second cable having at lease one second wire, the second assembly configured to mate with the first assembly to thereby connect the first cable to the second cable, the first and second assemblies each comprising:

a front shell;

a housing having a front region and a rear region, the front region coupled to the front shell in fixed relationship thereto;

a rear shell having a front facing, radially extending, rear shell abutment shoulder and a shell front end;

a contact insert having a contact front end for receiving the ends of the wires and a contact rear end with at least one mating contact, and further having a rear facing radially disposed contact insert abutment flange for abutting against the rear shell abutment shoulder and having a front facing radially disposed contact insert abutment shoulder;

a spacer having a first end positioned in abutting relationship against the contact insert abutment shoulder and a second end opposite the first end;

a spacer retaining means for being axially disposed and retained in the rear shell, the spacer retaining means having one end abutting against the second end of the spacer for causing the contact insert abutment flange to be pressed into contact against the rear shell abutment shoulder for axially positioning and retaining the contact insert in the rear shell; and interconnect means for interconnecting the housing and the rear shell in axially and rotationally immoveable relationship;

the first assembly further having an engaging means on the rear shell in rotationally moveable but axially retained relationship on the rear shell; and the rear shell of the second assembly further having an engagement end, the engaging means mountable to the engaging means for coupling the first and second assemblies together whereby the mating contacts of the first and second assemblies are coupled together for electrically coupling the first and second cables.

11. The connector of claim 10 wherein the first assembly has a radially disposed first mating surface and the second assembly has a radially disposed second mating surface, the first and second mating surfaces positioned in abutting relationship to each other to define a mating junction edge therebetween when the first and second assemblies are in fully mated relationship to one another, the first and second assemblies having annular alignment means for annularly aligning the first and second assemblies in a predefined fixed annular mating alignment, the connector further comprising a positive mate indicating apparatus comprising:

a first indicator band disposed on the rear shell outside surface of the first assembly to extend forwardly from the first mating surface, the first indicator band being positioned in a predefined annular location relative to annular alignment means;

a second indicator band disposed on the second shell outside surface of the second assembly to extend forwardly from the second mating surface, the second indicator band being positioned in the predefined annular location relative to the annular alignment means whereby the first and second indicator bands will align with each other across the mating junction edge in a continuous single indicator band when the first assemble is in fully mated relationship with the second assembly but showing a visible discontinuity at the mating junction edge when the first assembly is not in fully mated relationship with the second assembly; and the housing retaining nut on the first assembly having at least one radially disposed orifice therethrough, the orifice juxtaposed opposite a portion of the mating junction edge for enabling visual observation of the indicator bands to observe the relative alignment of the indicator bands for confirming that the first and second assemblies are in the fully mated relationship to each other.

* * * * *